US009033037B2

(12) United States Patent
Cens et al.

(10) Patent No.: US 9,033,037 B2
(45) Date of Patent: May 19, 2015

(54) INSTRUMENTED TUBING AND METHOD FOR DETERMINING A CONTRIBUTION TO FLUID PRODUCTION

(75) Inventors: Fabien Cens, Massy (FR); Yann Dufour, Vanves (FR); Christian Chouzenoux, Saint Cloud (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 713 days.

(21) Appl. No.: 12/911,814

(22) Filed: Oct. 26, 2010

(65) Prior Publication Data

US 2011/0100642 A1 May 5, 2011

(30) Foreign Application Priority Data

Oct. 29, 2009 (EP) ..... 09174404

(51) Int. Cl.
*E21B 43/12* (2006.01)
*E21B 43/14* (2006.01)
*E21B 47/10* (2012.01)

(52) U.S. Cl.
CPC ..... *E21B 47/10* (2013.01)

(58) Field of Classification Search
CPC ..... E21B 34/10; E21B 43/14
USPC ..... 166/250.01, 250.15, 250.17, 369, 54.1
See application file for complete search history.

(56) References Cited

U.S. PATENT DOCUMENTS

| | | | | |
|---|---|---|---|---|
| 6,047,239 | A | 4/2000 | Berger et al. | |
| 6,112,817 | A | 9/2000 | Voll et al. | |
| 7,311,152 | B2 * | 12/2007 | Howard et al. | 166/372 |
| 2001/0050170 | A1 * | 12/2001 | Woie et al. | 166/252.1 |
| 2004/0262011 | A1 | 12/2004 | Huckavbee | |
| 2006/0196668 | A1 * | 9/2006 | Burge et al. | 166/313 |
| 2007/0246210 | A1 * | 10/2007 | Richards | 166/56 |

FOREIGN PATENT DOCUMENTS

WO 03050385 6/2003

* cited by examiner

*Primary Examiner* — Brad Harcourt
(74) *Attorney, Agent, or Firm* — Cameron R. Sneddon

(57) ABSTRACT

An instrumented tubing for determining a contribution of a given zone to fluid production of a reservoir, the instrumented tubing including a tube having an open end for collecting a fluid flowing from the given zone and a port for coupling the tube to a production tubing for letting the collected fluid flow into the production tubing, and a sensor for measuring a parameter of the collected fluid, wherein the sensor is connected to an electronic unit for determining the contribution of the given zone to the fluid production of the reservoir based on said measured parameter.

12 Claims, 4 Drawing Sheets

INSTRUMENTED TUBING AND METHOD FOR DETERMINING A CONTRIBUTION TO FLUID PRODUCTION

FIELD

An aspect of the disclosure relates to an instrumented tubing and/or a method for determining a contribution of a given zone to fluid production of a reservoir, and in particular but not exclusively, of a hydrocarbon fluid mixture flowing from a given zone of a reservoir in a borehole of a producing hydrocarbon well.

BACKGROUND

During completion operations, the completion/production equipments like packers, production tubings, valves, various sensors or measuring apparatuses, etc. . . . are installed downhole. Subsequently, production operations can begin. It is known to deploy permanent sensors for measuring various parameter related to the reservoir, the borehole, the fluid flowing into the borehole, etc. . . . These sensors are used to monitor the downhole reservoir zones and control the production of hydrocarbon. Such monitoring of the production enables enhancing hydrocarbon recovery factor from reservoir by taking appropriate action, for example by isolating a zone excessively producing water compared to hydrocarbon fluid.

Typically, the sensors measure parameters of the fluid circulating inside the borehole (cased or uncased).

Such sensors do not allow a direct measurement of the contribution of each zone forming a reservoir. To the contrary, they scan the full borehole. As a consequence, such sensors have a large investigation depth. As another consequence, it is not possible to directly measure the flow contribution of a given zone. The contribution of a particular zone is determined by performing measurements related to fluid flowing inside the full borehole volume/section and comparing it to measurements performed in the adjacent zones, for example the upstream zones.

Further, in-situ downhole calibrations are difficult to implement and thus rarely applied as they would require shutting off the whole well production.

Such sensors cannot be intrusive, namely protruding inside the well bore because this may hinder or render impossible well interventions.

Such sensors have to be suitable for slow moving and segregated fluids often encountered in horizontal section of wells.

Such sensors are not adapted to several sizes of wellbore. Indeed, there isn't a unique sensor design fitting the various configurations encountered downhole.

Therefore, theses sensors are expensive. As a consequence, the number of zones that can be instrumented is limited.

Formation testing apparatus and method are known from U.S. Pat. No. 6,047,239. The apparatus and method enable obtaining samples of pristine formation or formation fluid, using a work string designed for performing other downhole work such as drilling, work-over operations, or re-entry operations. An extendable element extends against the formation wall to obtain the pristine formation or fluid sample. While the test tool is in standby condition, the extendable element is withdrawn within the work string, protected by other structure from damage during operation of the work string. The apparatus is used to sense or sample downhole conditions while using a work string, and the measurements or samples taken can be used to adjust working fluid properties without withdrawing the work string from the bore hole. When the extendable element is a packer, the apparatus can be used to prevent a kick from reaching the surface, adjust the density of the drilling fluid, and thereafter continuing use of the work string. Such apparatus and method are not adapted for permanent monitoring application of producing hydrocarbon well.

SUMMARY OF THE DISCLOSURE

It is an object of the present disclosure to propose an instrumented tubing and/or a method for determining a contribution of a given zone of a fluid flowing from a reservoir that overcomes one or more of the limitations of the existing measuring apparatuses and methods.

According to one aspect of the disclosure an instrumented tubing for determining a contribution of a given zone to fluid production of a reservoir, is provided. The tubing includes a tube having an open end and a port, the open end collecting a fluid flowing from the given zone and the port coupling said tube to a production tubing for letting the collected fluid flow into the production tubing, and a sensor for measuring a parameter of the collected fluid, wherein the sensor is connected to an electronic unit for determining the contribution of the given zone to the fluid production of the reservoir based on said measured parameter.

According to another aspect, there is provided a production controlling system of a producing zone of a well comprising a production tubing coupled to an instrumented tubing, the system comprising a first and a second insulation packers isolating the producing zone from adjacent zones, a valve of the instrumented tubing to control the producing zone, the valve being coupled to the electronic unit, the electronic unit operating the valve in dependence of determined contribution and a threshold parameter value or range.

According to yet another aspect, there is provided a method for determining a contribution of a given zone to a fluid production of a reservoir, comprising: collecting a fluid flowing from the given zone by an instrumented tubing, letting flow the collected fluid from the instrumented tubing into a production tubing, measuring a parameter of the collected fluid, and determining the contribution of the given zone to the produced fluid of the reservoir based on said measured parameter.

The instrumented tubing and method allows scanning the fluid in a small tube rather than the full bore, which is simple, reliable over time and cost effective. They may be used in permanent application while enabling a minimum impact on the well completion. In effect, the instrumented tubing miniaturization and sensors position within the instrumented tubing renders the instrumented tubing suitable for placement in borehole. The instrumented tubing enables long lifetime function according to determined specifications in harsh downhole environments (high pressure and/or temperature, corrosive environment). Further, this solution enables monitoring a larger number of producing zones of a well and improving the metrological performances. In particular, each zone can be isolated and monitored independently which enables determining the contribution of a specific zone to the total produced fluid. Furthermore, when the instrumented tubing is combined with downhole flow control devices, specific zone can be choked and/or in-situ calibration of the sensors can be performed without shutting off all the producing zones.

BRIEF DESCRIPTION OF THE DRAWINGS

The present disclosure is illustrated by way of example and not limited to the accompanying Figures, in which like references indicate similar elements.

DETAILED DESCRIPTION

Figure 1:
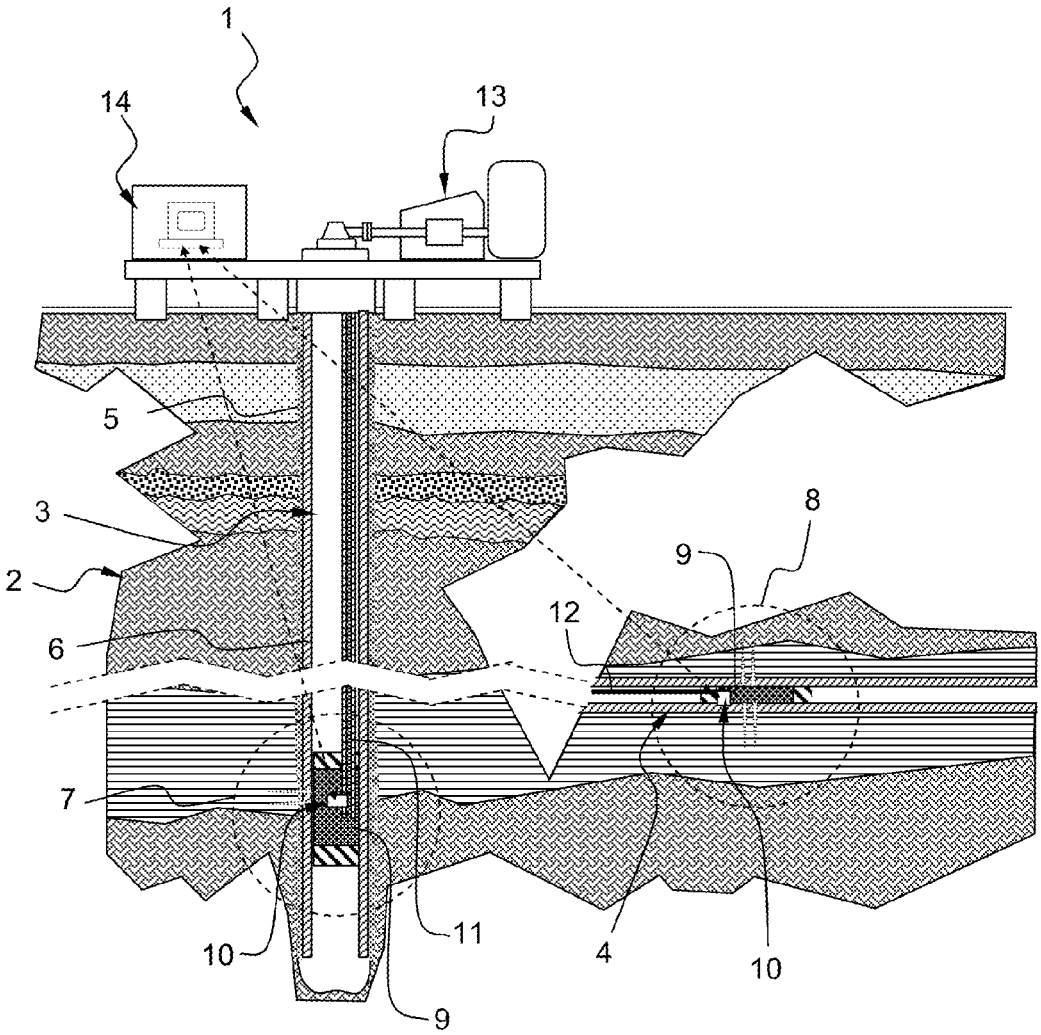
FIG. 1 schematically shows an onshore hydrocarbon well location illustrating examples of deployment of the instrumented tubing of the disclosure.

FIG. 1 schematically shows an onshore hydrocarbon well location and equipments 1 above a hydrocarbon geological formation 2 after drilling operation has been carried out, after a drill pipe has been run, and after cementing, completion and perforation operations have been carried out. The well is beginning producing hydrocarbon, e.g. oil and/or gas. At this stage, the well bore comprises substantially vertical portion 3 and may also comprise horizontal or deviated portion 4. The well bore 3, 4 is either an uncased borehole, or a cased borehole comprising a casing 5 and an annulus 6, or a mix of uncased and cased portions.

The annulus 6 may be filled with cement or an open-hole completion material, for example gravel pack. Downhole, a first 7 and second 8 producing sections of the well typically comprises perforations, production packers and production tubing at a depth corresponding to a reservoir, namely hydrocarbon-bearing zones of the hydrocarbon geological formation 2. In one embodiment, one or more instrumented tubing 10 for measuring the parameters of the fluid mixture 9 flowing into the cased borehole, for example in the first 7 and second 8 producing sections of the well (as represented in FIG. 1) or other sections of the well (not represented in FIG. 1), may be coupled to production tubings 11, 12 of the completion. In the present example, the fluid mixture is a hydrocarbon fluid mixture that may comprise oil, gas and/or water.

At the surface, the production tubings are coupled to appropriate surface production arrangement 13 typically comprising pumping arrangement, separator and tank, etc. Surface equipment 14 may comprise a computer forming a control and data acquisition unit coupled to the instrumented tubings of the disclosure, and/or to other downhole sensors and/or to active completion devices like valves. Surface equipment 14 may also comprise a satellite link (not shown) to transmit data to a client's office. Surface equipment 14 may be managed by an operator. The precise design of the down-hole producing section and surface production/control arrangement/equipment is not germane to the present disclosure, and thus is not described in detail hereinafter.

Figure 2:
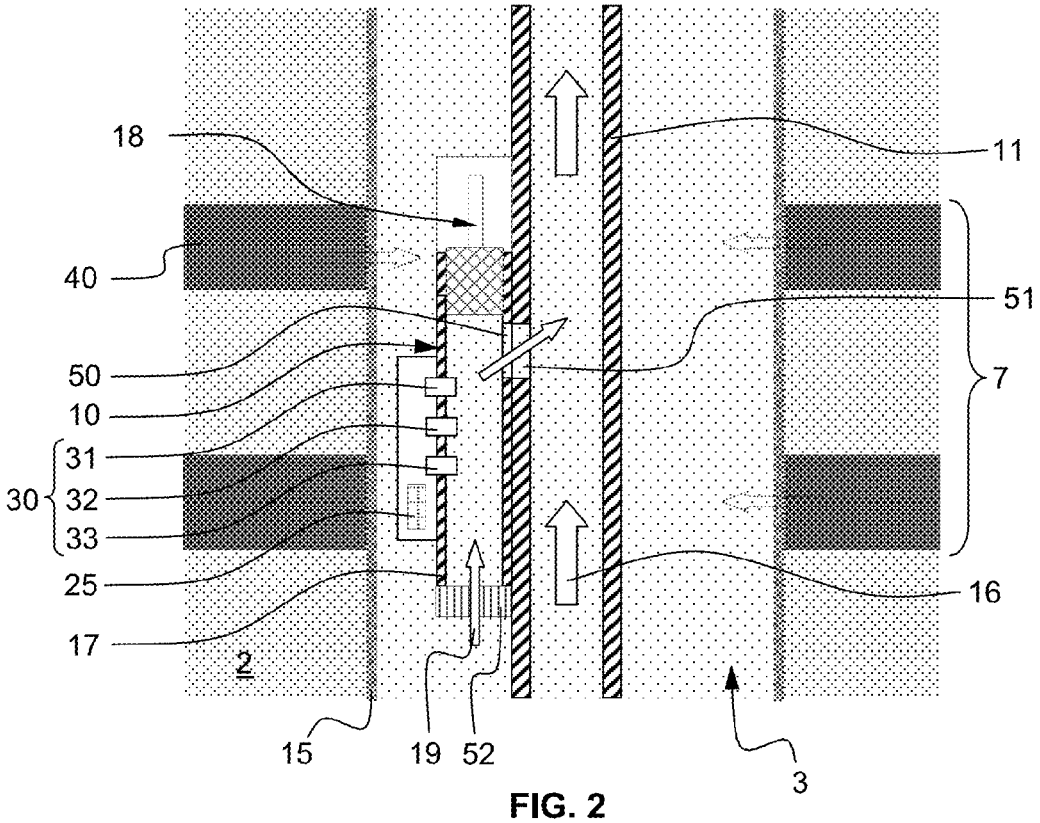
FIG. 2 is a front cross-section view in a geological formation schematically showing an instrumented tubing according to the disclosure coupled to a production tubing in an uncased borehole.

FIG. 2 is a front cross-section view of a geological formation 2 schematically showing an instrumented tubing 10. The producing hydrocarbon well 3 comprises an uncased borehole in a geological formation 2 comprising at least a oil bearing layer 40.

The well bore 3 is an uncased borehole that may be covered by a mudcake 15. Alternatively, the well bore should also be a cased borehole (shown in FIG. 5) comprising a casing and an annulus. The annulus may be filled with cement or an open-hole completion material, for example gravel pack, or formation sand, or formation fluids. The fluid mixture produced by the reservoir zone 7 flows towards the instrumented tubing 10 through the mudcake 15 or through appropriate perforations of the casing. The well bore 3 further comprises a completion consisting of a production tubing 11. It may further comprise a packer and a series of perforations in a cased portion of the borehole (not shown). A produced hydrocarbon fluid mixture 16 flows towards the surface through the production tubing 11. In the production zone 7, the instrumented tubing 10 is coupled to the production tubing 11. The hydrocarbon fluid mixture flowing from the production zone 7 flows into the production tubing 11 through the instrumented tubing 10.

The instrumented tubing 10 comprise a tube 17 that may have a length ranging from a few dozen of centimeters to a meter (corresponding to 0.5 foot to 3 feet long), and a diameter ranging from a few centimeters to a dozen of centimeters (corresponding to 1 to 5 inches in diameter). The instrumented tubing can fit most of the tubing and/or casing configurations due to its relatively small size compared to well bore diameter. In particular, one single size of tube may fit all tubing/casing configurations. A first end of the instrumented tubing is open, while the second end is closed. The instrumented tubing further comprises a lateral hole 50. For example, the instrumented tubing and the production tubing are coupled in a parallel manner and comprise holes 50, 51 respectively facing each other such as to form a flow port enabling communication between both tubings. Thus, the fluid mixture 19 flowing from the producing zone 7 may flow into the production tubing 11 after having flown through the instrumented tubing 10. The instrumented tubing 10 may be made of conductive material, for example stainless steel or other metal alloy capable of withstanding high temperature and corrosive environments. The instrumented tubing 10 may also be made of plastic. In both cases, advantageously, the instrumented tubing withstands the absolute pressure resulting of the hydrostatic column of fluid above the instrumented tubing position, and the differential pressure corresponding to the maximum reservoir drawdown pressure.

The small inner diameter of the tube enables creating a turbulent flow proper to achieve an efficient fluid mixing over a wide range of flow rate. Such a good mixing quality enables achieving good metrological performances notably in presence of multi-phase fluid mixture that tends to segregate in horizontal or slightly deviated well sections. As an alternative, the tube may further comprise a mixing element (not shown) such as a restriction or a rotating element like a helix.

The instrumented tubing 10 comprises various sensors 30 measuring various parameters of the fluid. The good mixing quality combined with the small inner diameter allow the use of sensors having a small investigation depth like local sensors. For example, the sensor 30 may be a flow meter 31, a water fraction sensor 32, a viscosity sensor 33. It may further comprise any kind of sensor, e.g. electrical, resistive, capacitive, acoustic and/or optical, etc. . . . sensors. The sensors may be intrusive sensors protruding inside the tube 17. The sensors enable analyzing the fluid flowing in the instrumented tubing in order to determine the fluid properties. For example parameters like the pressure, the temperature, the total flow rate, the different fluid hold-up and cuts, the salinity, and/or the viscosity, etc. . . . of the fluid may be determined. Various holes or windows are machined into the tube 17 in order to create ports for receiving the sensors. The sensors 30 are fitted within these holes or windows of the tube 17. The sensors 30 are connected to an electronic unit 25. The differential pressure between the inside of the tube 17 and the well bore 3 is expected to be low because the instrumented tubing is located into the well bore. Thus, pressure sealing mechanisms for the sensors are not required. Consequently, the sensors can be screwed, or press fitted, or glued, or welded, etc. . . .

The whole volume of fluid mixture 19 produced by the given reservoir zone 7 flowing towards the production tubing 11 can be measured by the sensors 30. Further, as the sensors only protrude inside the tube 17 and measure the parameters of the fluid flowing inside the tube 17, the well interventions can be easily implemented.

The electronic unit 25 coupled to the sensors 30 comprises typical components, like an ND converter, a processor, a memory that will not be further described. The electronic unit 25 calculates fluid properties based on the parameters measured by the sensors. The electronic unit 25 may also comprise a transmission module for transferring the measurements to the surface. The measurements may be transferred by wireless communication (e.g. acoustics or electromagnetic) or by wire between the transmission module and surface equipment 14 (shown in FIG. 1). The electronic unit 25 may also be coupled to a control valve that will be described in details hereinafter.

Prior to the deployment of the instrumented tubing 10, the sensors 30 together with the electronic unit 25 may be calibrated.

The instrumented tubing may be coupled on the open end to a filtering element 52, for example a sand screen. The filtering element 52 avoids clogging the tube 17 and/or the holes 50, 51. It may also avoid excessive erosion of the tube itself but also of the sensors 30 protruding inside the tube 17.

The instrumented tubing 10 may further comprise a control valve 18 to choke the hydrocarbon fluid mixture production of the given producing zone 7. When the control valve 18 is closed, the production of the given producing zone 7 is interrupted (not shown). When the control valve 18 is open the production of the given producing zone 7 is resumed (as shown). When the control valve 18 is in an intermediate position, the flow rate of the produced fluid can be controlled such as to optimize the drawn down and enhance the oil sweeping efficiency from the given producing zone 7. The control valve 18 may operate in response to specific commands received from the surface equipment 14. Further, it may also operate in response to specific commands send by the local sensor 30, for example a water fraction sensor detecting the ratio of water or oil in the fluid mixture produced by the specific production zone. Furthermore, it may also operate in response to specific commands send by the electronic unit 25.

Advantageously, the flow control valve may be used to shutoff the production of a given zone. The production of a given zone may be stopped when a contribution of said zone determined by the instrumented tubing is above or lower than a threshold parameter value, or out of a determined range of parameter values. As an example, the production of a given zone may be stopped when the water/oil ratio is above a given threshold, namely when said zones produces water in excess.

Advantageously, the flow control valve may also be used to perform downhole in-situ calibration of the sensors, in particular flow-rate sensor. With the instrumented tubing, only the zone requiring calibration has to be shut off. This does not require shutting off the whole well production. Indeed, when the control valve is closed the flow rate of the fluid flowing through the instrumented tubing is zero. The control valve may shut-off the flow in the instrumented tubing at periodic interval in order to determine the differential drift and offset of some sensors. Then, correction may be applied to the corresponding measurements by the electronic unit. This correction may be updated at each subsequent control valve shut-off. This is a practical procedure to limit sensor drift and achieve better metrological performances over the long term.

The instrumented tubing 10 may be secured to the production tubing 11 by means of a casing of the control valve 18, or welding, or a flange, etc. . . .

FIG. 2 shows an embodiment wherein the instrumented tubing 10 and the production tubing 11 are welded together.

Figure 3:
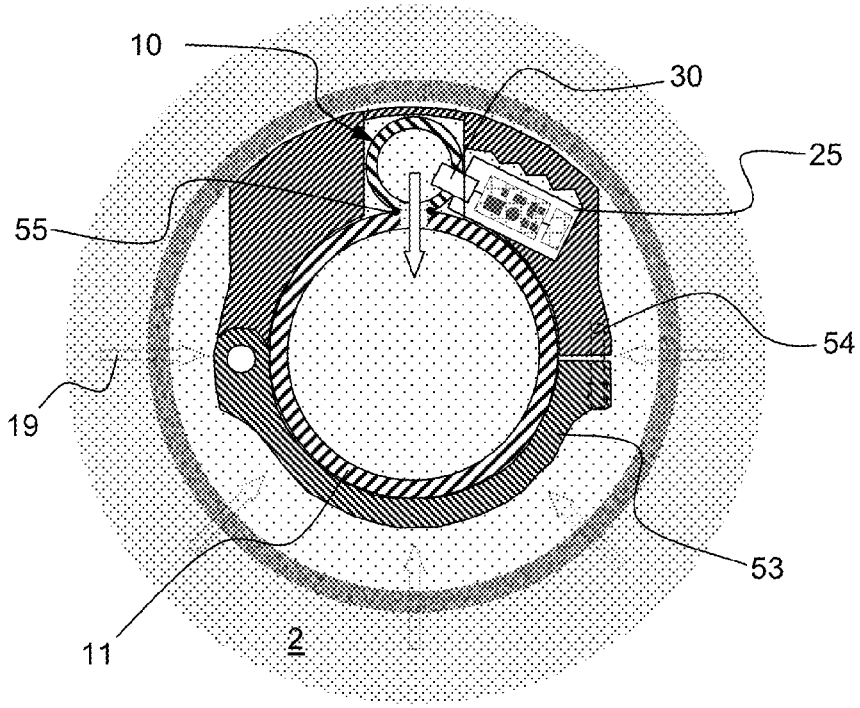
FIG. 3 is a top cross-section view schematically showing in details the instrumented tubing of the disclosure.

FIG. 3 shows another embodiment wherein the instrumented tubing 10 is coupled to the production tubing 11 by means of a clamp 53 secured by screws 54. The electronic unit 25 is positioned and secured in an appropriate cavity in the clamp 53.

Figure 4:
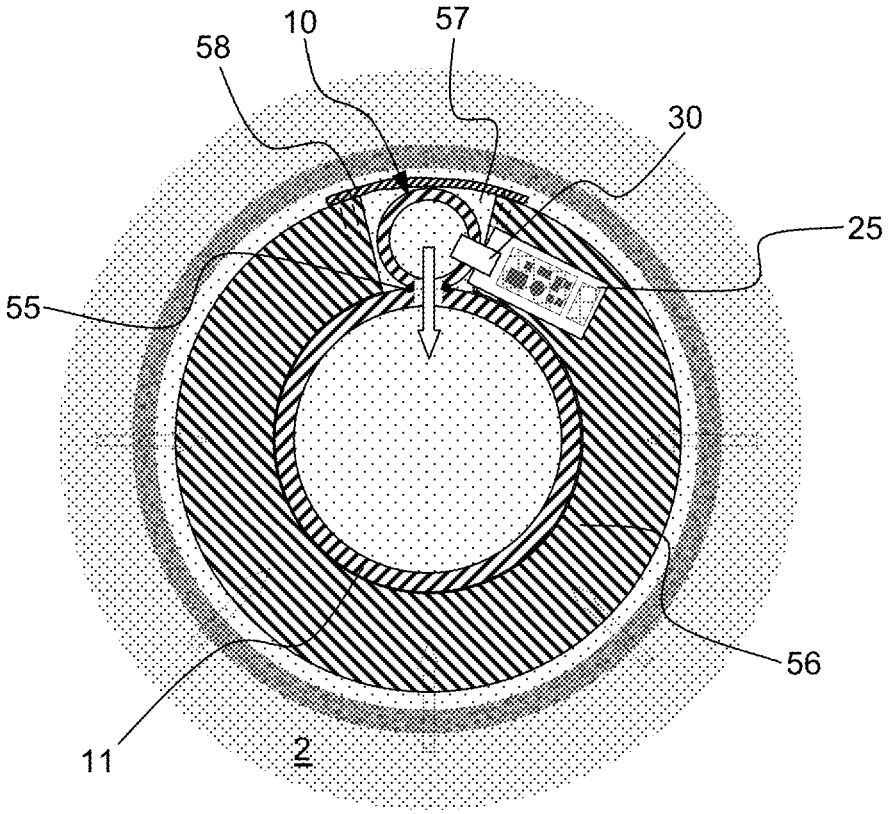
FIG. 4 is a top cross-section view schematically showing in details the instrumented tubing of the disclosure.

FIG. 4 shows another embodiment wherein the production tubing further comprises a solid mandrel 56 comprising a longitudinal groove 57 receiving the instrumented tubing 10 while allowing the fluid to be collected by the open end of the tube. The instrumented tubing 10 is secured in the groove 57 by means of a plaque 58 screwed in the mandrel. Alternatively, the instrumented tubing 10 may be directly screwed in the mandrel. The solid mandrel 56 has at least the length of the instrumented tubing. The electronic unit 25 is positioned and secured in an appropriate cavity in the solid mandrel 56.

The instrumented tubing 10 and the production tubing 11 may be sealed together in the zone of the holes 50, 51. The sealing 55 may be achieved by metal/metal seal, O-ring, or C-ring, etc. . . .

Thus, the instrumented tubing 10 enables collecting, mixing and measuring properties of fluids flowing from a reservoir zone before they are produced into the production tubing.

The instrumented tubing enables scanning a tube of small section with local intrusive sensors. This is a cost effective solution compared to measuring fluid properties in the whole well bore section. Thus, it enables extending such downhole measurements to a number of zones, e.g. fifteen to fifty zones, that exceeds by far what is commonly monitored today, e.g. four to five zones for lower or at least the same cost.

Figure 5:
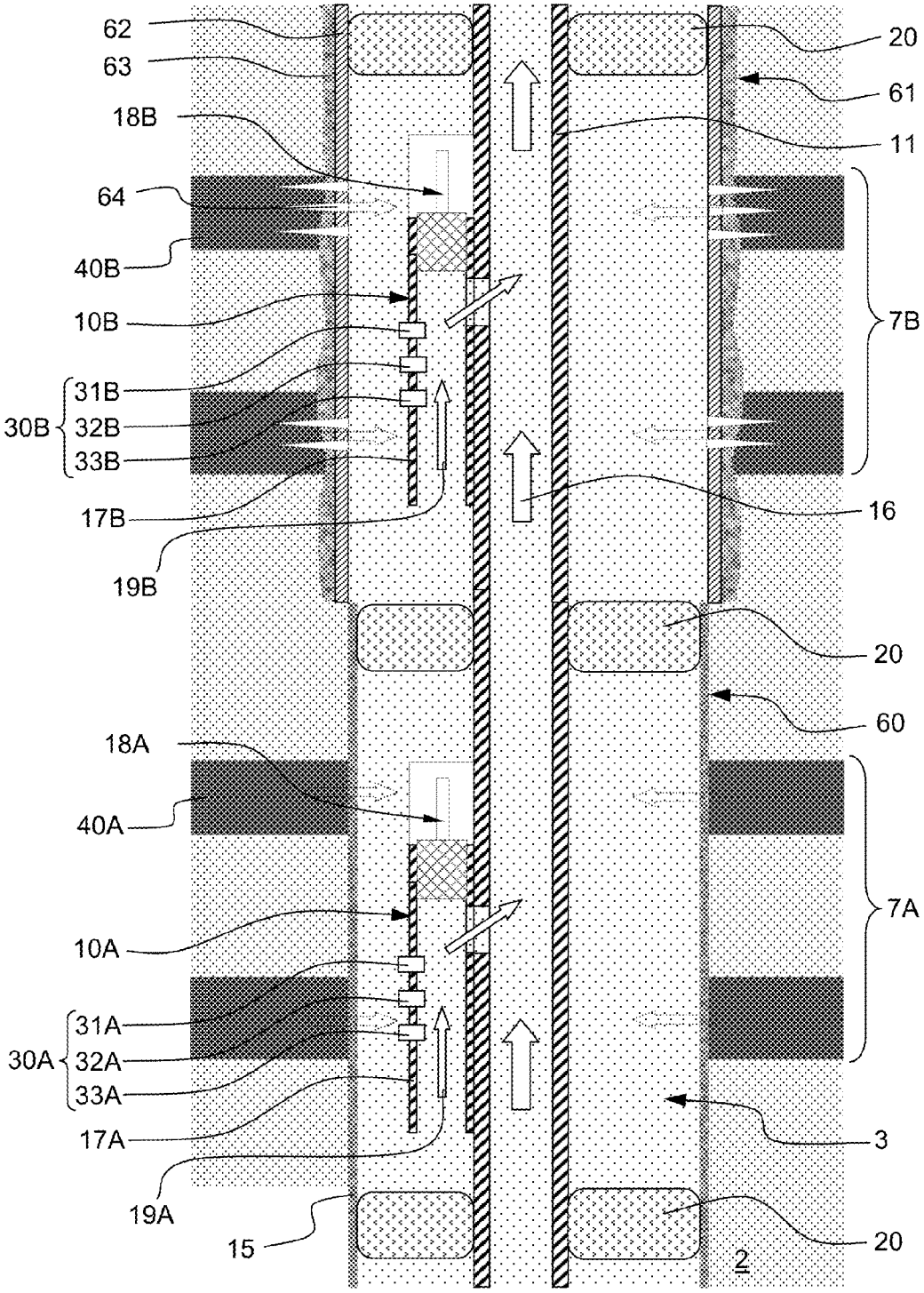
FIG. 5 is a front cross-section view in a geological formation schematically showing two instrumented tubings associated to two different producing zones in a mixed cased and uncased well bore configuration.

FIG. 5 is a front cross-section view of a geological formation forming a reservoir 2 schematically illustrating how the well 3 can be sectioned in multiple compartments. Each compartment is isolated from the other one by means of isolation packer 20. Each compartment may be equipped with an instrumented tubing 10A, 10B that collects the fluid 19A, 19B flowing from the oil bearing layers 40A, 40B before it flows into the production tubing 11.

FIG. 5 shows two instrumented tubings 10A, 10B associated to two different producing zones 7A, 7B in an uncased borehole and in a cased borehole, respectively. The well bore 3 comprises a first portion comprising the uncased borehole 60 covered by a mudcake 15, and a second portion comprising a cased borehole 61 comprising a casing 62 and an annulus 63 filled with cement or a completion material. The cased portion further comprises perforation 64 for letting flow the hydrocarbon fluid from oil bearing layers 40B into the well 3.

The two producing zones 7A, 7B are separated from each other by the isolation packer 20. Though FIG. 5 depicts two instrumented tubings 10A, 10B, one associated to a first production zone 7A and one associated to a second production zone 7B, further instrumented tubings may be deployed in order to separate a plurality of producing zones. The other elements of the instrumented tubings 10A, 10B, namely the sensors 30A, 31A, 32A, 33A, 30B, 31B, 32B, 33B, the valves 18A, 18B, and the coupling with the production tubing 11 are identical to the ones described in relation to the FIG. 2 embodiment and will not be further described.

When the valve 18A is in an open state, letting the fluid flowing through the instrumented tubing 10A. The fluid 19A flowing from the first production zone 7A is collected by the instrumented tubing 10A, flows through it towards the production tubing 11. In a continuous manner, various parameters or characteristic values related to the collected fluid 19A can be measured by the various sensors 30A. The contribution to the produced fluid 16 of the first given zone 7A of the reservoir may be determined based on said measured parameter. The position of the valve 18A may be set in a position ranging from the open state to a closed state. When the valve 18A is in an intermediate position, the flow rate of the produced fluid can be controlled. Advantageously, the valve 18A is operated such that the determined contribution of the fluid production of the first given zone 7A stays within a determined range, or do not excessively deviate from a threshold parameter value. A similar method is also implemented for the second given zone B and other zones (not represented).

Thus, the sectioning of the well enables direct measurements of the contribution of a given zone by forcing the fluid to be produced through the corresponding instrumented tubing located into the well. The instrumented tubing may collect real time measurements related to a given zone enabling analyzing the contribution of each zone. The state of the flow control valve 18A or 18B can be set in order to optimize the drawn down and enhance the oil sweeping efficiency by delaying as much a possible the moment when the water is going to breakthrough in a given zone.

It should be appreciated that embodiments of the disclosure are not limited to onshore hydrocarbon wells and can also be used offshore. Furthermore, although some embodiments have drawings showing a vertical well-bore, said embodiments may also apply to a horizontal or deviated well-bore. All the embodiments of the disclosure are equally applicable to cased and uncased borehole.

The embodiments of the disclosure may also apply to fluid injection. The instrumented tubing can be used as a flow control unit to monitor and optimize the injection of fluids inside a reservoir, from surface down to a specific zone where a control valve is positioned.

The embodiments of the disclosure may further apply to detect and measure re-circulation of fluids between different zones or compartments of the well. The reservoir fluid re-circulation can occur in case of differential pressure between zones. The disclosure allows detecting an undesirable situation wherein one zone of the reservoir produces inside another zone.

Although particular applications of the disclosure relate to the oilfield industry, other applications to other industry, e.g. the water industry or the like also apply.

The drawings and their description hereinbefore illustrate rather than limit the disclosure.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. An instrumented tubing for determining a contribution of a given zone to fluid production of a reservoir, the instrumented tubing comprising:

a tube having an open end, a closed end, a circumferential sidewall extending between the open end and the closed end, and a port defined in the circumferential sidewall, the tube configured to be laterally coupled to a production tubing in a parallel manner at the port with the port being adjacent a corresponding opening in the production tubing, putting in fluid communication the tube with the production tubing, the open end collecting a fluid flowing from the given zone and the port letting the collected fluid flow into the production tubing;

a sensor positioned within the tube for measuring a parameter of the collected fluid, wherein the sensor is connected to an electronic unit for determining the contribution of the given zone to the fluid production of the reservoir based on said measured parameter; and a control valve disposed at the closed end of the tube and extending downwardly toward the port to adjust the flow of fluid flowing through the tube towards the production tubing.

2. The instrumented tubing according to claim 1, wherein the tube has a shape creating a turbulent flow such as to mix the collected fluid in the instrumented tubing.

3. The instrumented tubing according to claim 1, wherein the tube further comprises a filtering element.

4. The instrumented tubing according to claim 1, wherein the tube further comprises a mixing element.

5. The instrumented tubing according to claim 1, wherein the tube is made of a metal alloy or a plastic material capable of withstanding a high temperature and/or corrosive environment.

6. The instrumented tubing according to claim 1, wherein the fluid is a hydrocarbon fluid mixture.

7. The instrumented tubing according to claim 1, wherein the electronic unit further comprises a transmission module to transfer measurements to surface equipment.

8. A production controlling system of a producing zone of a well comprising:

a production tubing;

a instrumented tubing for determining a contribution of a given zone to fluid production of a reservoir coupled to the production tubing, the instrumented tubing compromising;

a tube having an open end, a closed end, a circumferential sidewall extending between the open end and the closed end, and a port defined in the circumferential sidewall, the tube configured to be laterally coupled to a production tubing in a parallel manner at the port with the port being adjacent a corresponding opening in the production tubing, putting in fluid communication the tube with the production tubing, the open end collecting a fluid flowing from the given zone and the port for letting the collected fluid flow into the production tubing;

a sensor positioned within the tube for measuring a parameter of the collected fluid, wherein the sensor is connected to an electronic unit for determining the contribution of the given zone to the fluid production of the reservoir based on said measured parameter; and a control valve disposed at the closed end of the tube and extending downwardly toward the port to adjust the flow of fluid flowing through the tube towards the production tubing;

a first and a second insulation packers isolating the producing zone from adjacent zones; and the control valve of the instrumented tubing to control the producing zone, the control valve being coupled to the electronic unit, the electronic unit operating the control valve in dependence of determined contribution and a threshold parameter value or range.

9. A method for determining a contribution of a given zone to a fluid production of a reservoir, comprising:

collecting a fluid flowing from the given zone by an instrumented tubing the instrumented tubing compromising;

a tube having an open end, a closed end, a circumferential sidewall extending between the open end and the closed end, and a port defined in the circumferential sidewall, the tube configured to be laterally coupled to a production tubing in a parallel manner at the port with the port being adjacent a corresponding opening in the production tubing, putting in fluid communication the tube with the production tubing, the open end collecting a fluid flowing from the given zone and the port for letting the collected fluid flow into the production tubing;

a sensor positioned within the tube for measuring a parameter of the collected fluid, wherein the sensor is connected to an electronic unit for determining the contribution of the given zone to the fluid production of the reservoir based on said measured parameter; and a control valve disposed at the closed end of the tube and extending downwardly toward the port to adjust the flow of fluid flowing through the tube towards the production tubing;

letting flow the collected fluid from the instrumented tubing into the production tubing, and measuring a parameter of the collected fluid, and determining the contribution of the given zone to the produced fluid of the reservoir based on said measured parameter; and adjusting the flow of the fluid flowing through the tube towards the production tubing, wherein adjusting the flow is performed at the port.

10. The method according to claim 9, wherein the collected fluid is further mixed before being measured.

11. The method according to claim 10, wherein the fluid is a hydrocarbon fluid mixture.

12. The method according to claim 10, further including;

sectioning the well by isolating a given producing zone from adjacent producing zones;

determining the contribution of the given zone to the fluid production of the reservoir; and operating a valve of the instrumented tubing to control the fluid production of the given zone of the reservoir based on the determined contribution and a threshold parameter value or range.

* * * * *